US005802629A

United States Patent [19]

Zietek

[11] Patent Number: 5,802,629

[45] Date of Patent: Sep. 8, 1998

[54] SELF-DRAINING POOL COVER

[76] Inventor: Edward Zietek, 100 Riverside Dr., New York, N.Y. 10024

[21] Appl. No.: 780,678

[22] Filed: Jan. 8, 1997

[51] Int. Cl.[6] ..... E04H 4/00

[52] U.S. Cl. ..... 4/498; 4/496

[58] Field of Search ..... 4/498, 499, 500, 4/502, 503, 501, 488, 496

[56] References Cited

U.S. PATENT DOCUMENTS 5,259,078 11/1993 Crandall ..... 4/498
5,594,960 1/1997 Stern ..... 4/498

*Primary Examiner*—David J. Walczak
*Attorney, Agent, or Firm*—Richard B. Klar

[57] ABSTRACT

An apparatus for the self draining of a pool cover includes a pool cover having a surface area that is at a lower elevation than a remaining surface area of the pool cover to remove accumulations from the pool cover by gravity. A drain fitting having a passageway is attached to the aperture in the pool cover. A first hose, to remove accumulations, is connected to the drain fittings. There is also provided in the apparatus disposal means which include an outlet on a wall of the pool and a second hose on the other side of the wall connected to the outlet. Accumulations flowing through the first hose exit the pool through the pool wall for final disposal by a second hose to direct where desired.

14 Claims, 3 Drawing Sheets

Self-Draining Pool Cover

Self-Draining Pool Cover

Self-Draining Pool Cover

SELF-DRAINING POOL COVER

BACKGROUND OF THE INVENTION

1. Field of the Invention

The present invention relates to a pool cover. In particular the present invention relates to a self-draining pool cover for removal through gravity means of the accumulation of water, dirt and other residue which can collect during the off-season that a pool is not in use. The present invention provides for a self-draining pool cover in which accumulations of water and dirt on the cover are removed through a drain assembly and conduit to a disposal point such as a sewer or a backyard or any other available means or diverted as is appropriate.

2. The Prior Art

Pool covers are known in the art. U.S. Pat. No. 3,184,764 to West relates to a swimming pool cover for draining accumulations of rain water, but which screens out by means of a screen (1), large leaves, dirt and trash which are left on the top of the pool cover.

It is therefore a desirable to provide a pool cover which can remove accumulations of water and other residue in an efficient and simple manner.

SUMMARY OF THE INVENTION

It is a principle object of the invention to have a self draining pool cover in which accumulations on the cover are disposed of by gravity through the cover.

It is a further object of the invention to have the accumulations on the pool cover disposed of through a sidewall of a pool. In order to accomplish these objectives the present invention includes a pool cover having a surface area and an aperture located within a portion of the surface area. The portion of the surface area of the pool cover being at a lower elevation than a remaining surface area of the pool cover to remove accumulations from the pool cover by gravity. In addition, there are conduit means for disposing the accumulations including an outlet in a wall of the pool.

Further objects will become more readily apparent in the description and drawings provided.

BRIEF DESCRIPTION OF THE DRAWINGS

FIGS. 4A–4C show both sides of the pool wall through which the present invention is connected therethrough in which:

FIG. 4A shows a second hose connected at the other side of the pool wall to permit the accumulation to be drained through the pool wall into disposal means such as a sewer when the pool cover is in place over the pool;

FIG. 4B shows a plug replacing the second hose to seal the opening through the wall for when the pool is in use; and FIG. 4C shows the plug in place.

DETAILED DESCRIPTION OF THE INVENTION

Figure 1:
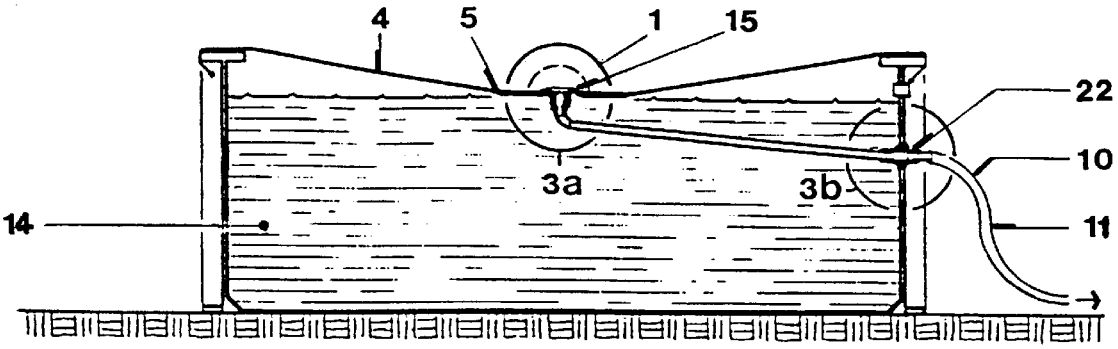
FIG. 1 is a sectional view of the invention in conjunction with a typical pool.
Figure 2:
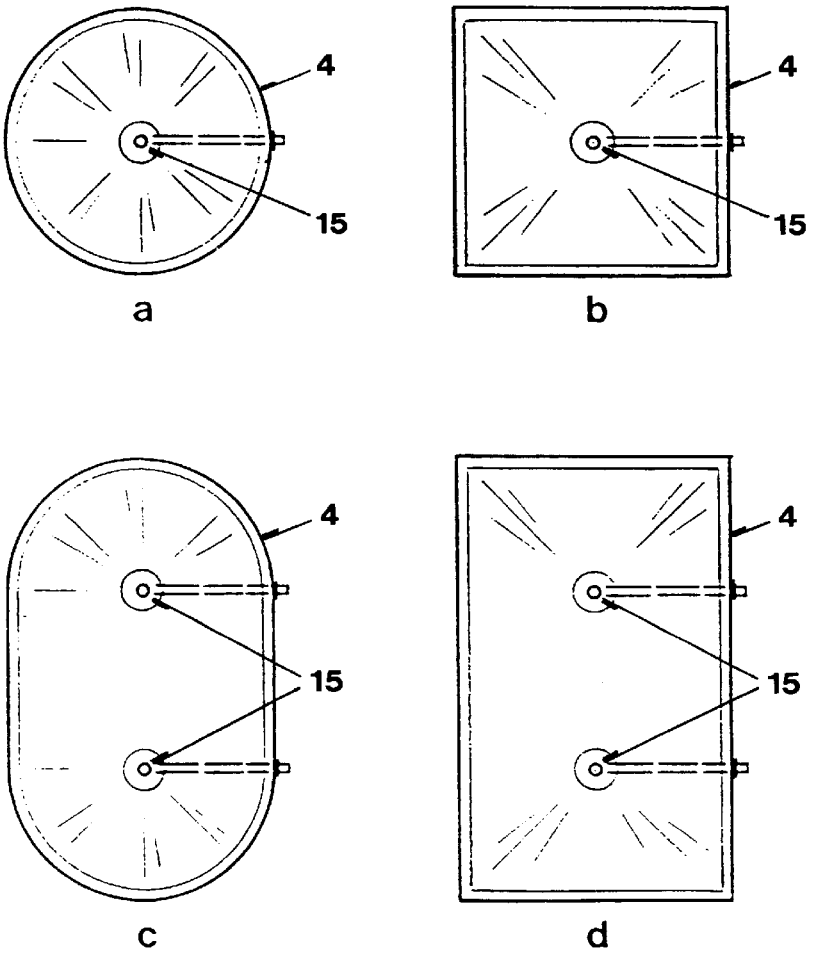
FIG. 2A shows one embodiment of the invention in which the pool cover is shaped circularly.
FIG. 2B is an embodiment showing a square-shaped pool cover.
FIG. 2C shows another embodiment with an oval or oblong-shaped pool cover.
FIG. 2D shows another embodiment with a rectangular-shaped pool cover.
Figure 3:
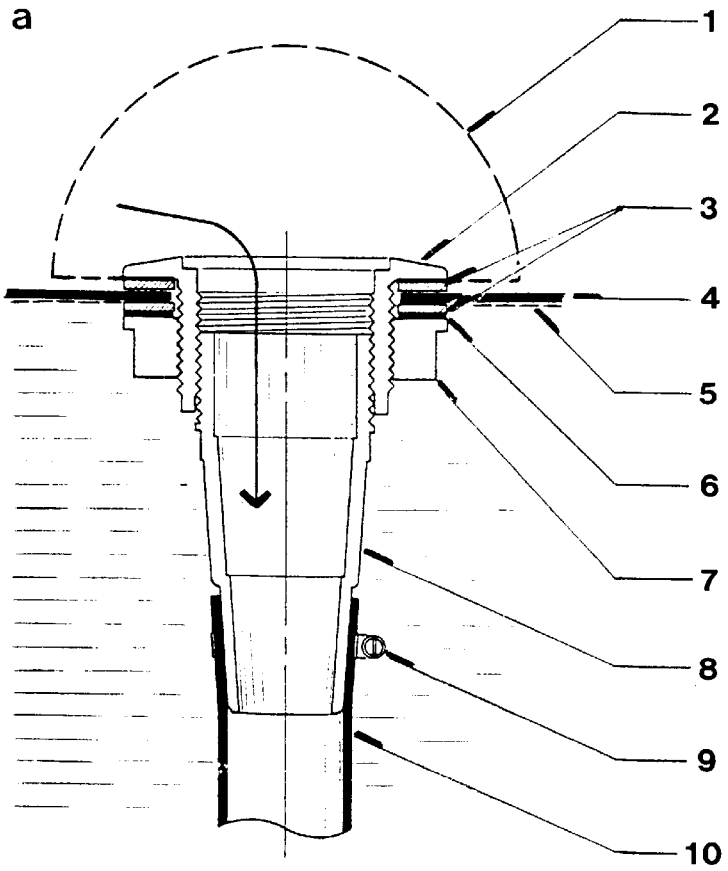
FIG. 3A shows a partial sectional detail view of the drain embodiment in FIG. 1 of the conduit means connected to the aperture of the pool cover.
FIG. 3B. shows a partial sectional detail view of the outlet embodiment in FIG. 1 continuing the conduit means through the pool wall to an outlet assembly to a second hose on the outer side of the pool wall.
Figure 3:
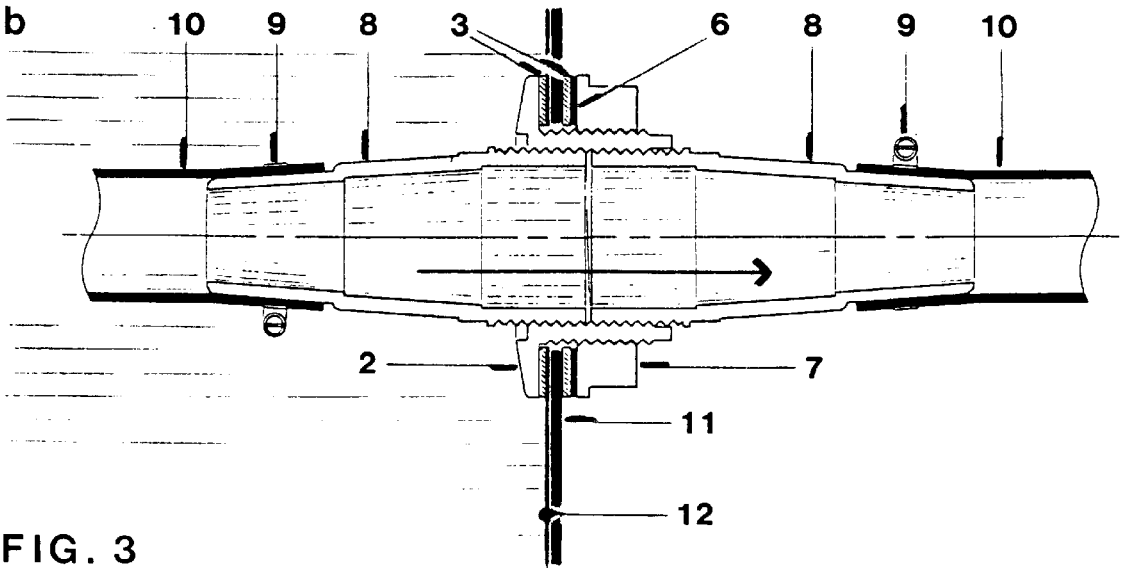
Figure 4:
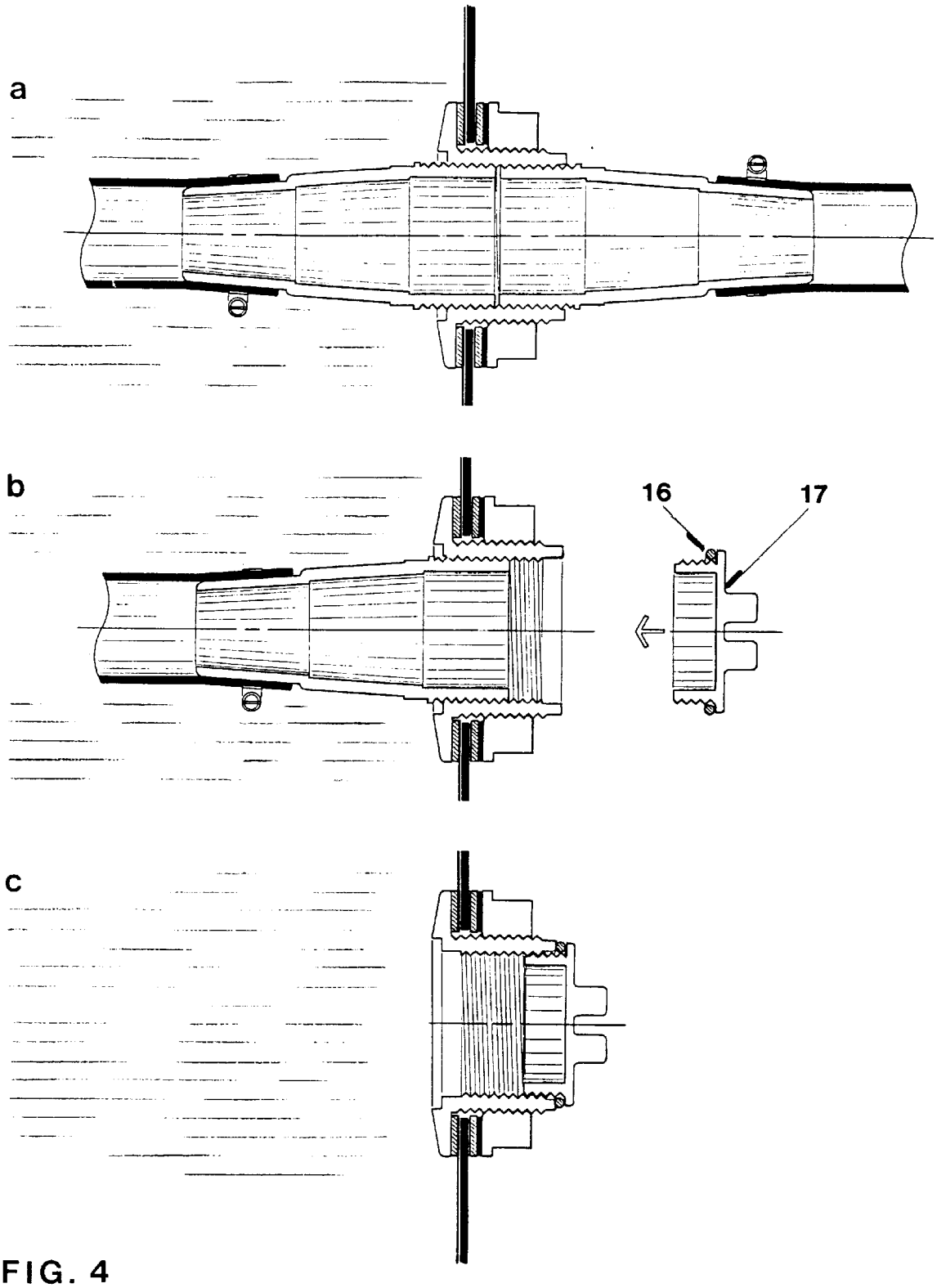

Referring to the drawings of FIGS. 1–4, and in particular FIG. 1 illustrates a self-draining pool cover in which accumulations on the pool cover are disposed of by gravity through a drain/conduit/outlet assembly where a second hose can direct water as desired.

Specifically, in the preferred embodiment of FIG. 1, a pool is filled with water (15) to a skimmer level. A pool cover(4) is fastened to a deck or pool rim. The drain outlet (22) is at least six inches below the skimmer level. The hose (10) is placed under the water and connected as shown in FIG. 1 to the drainage outlet (22). The pool cover (4) has an aperture with a drain fitting or flange (2) attached to the aperture. The aperture may be covered by a leaf screen (1 as shown in FIG. 1). The drain assembly (FIG. 3A) is preferably located in the center portion of the pool cover(4) at a lower elevation then the remaining portion of the pool cover(4). A flexible hose (10) connects the drain flange (2) to an outlet assembly (FIG. 3B) in the pool wall (11). The flange(2) is preferably connected as shown in FIG. 3A to the pool cover (4) by use of top and bottom gaskets (3) made of rubber, a washer (6) of composite material, and a collar nut (7) made of plastic. The hose adaptor (8) connects drain flange (2) to hose (10) as secured by hose clamp (9). Element 12 in FIG. 3B denotes the pool liner.

A second hose (10) connected to the outlet assembly is located on the outer side of the pool wall (11). Both hoses (10) and (10) are preferably flexible and may be made of plastic material.

In using the self-draining pool cover in FIG. 1, accumulations on the pool cover are removed by gravity due to the lower elevation of the aperture (15) in relation to the remaining portion of the pool cover (4) and the first hose (10) being placed under water (14). A portion of the first hose (10) is placed in the water (14) in the pool to facilitate draining the accumulations. Accumulations on the pool cover (4) travel through the drain assembly into the flexible hose (10) and then out of the pool through the outlet assembly in the pool wall (11). Once the accumulations exit the pool wall (11), the accumulations enter the second hose (10) attached to the outlet assembly which can be diverted as desired.

The pool cover is not limited to any particular shape as is evident from FIGS. 2A through 2D which illustrate just some of the shapes such as circular—FIG. 2A, square—FIG. 2B, oval—FIG. 2C, or rectangular—FIG. 2D.

As seen in FIGS. 4A through C the second hose (10) can be removed from the outlet assembly at the pool wall and the outlet assembly can be sealed with a plug (17) and ring gasket (16) when the pool is in use and there is no need for the pool cover (4). During the off-season the pool cover can be placed back on and the plug (17) replaced with the second hose (10). The means for securing the second hose (10) to the outlet are the same as for the first hose (10) being coupled and parts such as a clamp and a hose adaptor are used in the same manner as shown in FIG. 3A for interconnecting the first hose to the drain flange (2) and also for connecting the other end of the first hose to the outlet.

This invention has a major advantage over the prior art. In the prior art, a typical non-draining pool cover water would accumulate on the pool cover surface, freeze, and cause it to break allowing accumulations to enter the pool or removing the cover when it has accumulation on it, the contaminated water can fall into the pool. This would make it necessary to go through the costly process of draining the pool and replacing the contaminated water with clean water. The present invention avoids these difficulties by providing a self-draining pool cover that employs gravity to clean the pool cover and have the accumulations exit through the pool through the pool wall. Therefore, the invention provides an easy, cost effective way of removing accumulations on the pool cover without pumps or siphons.

I do not limit myself to any particular details of construction set forth in the specification and illustrated in the accompanying drawings, as the same refers to and sets forth only certain embodiments of the invention, and it is observed that the same may be modified without departing from the spirit and scope of the claimed invention.

Having thus described the invention, what is claimed as new and desired to be secured by Letters Patent is as follows:

1. A self draining pool cover for covering water in a pool comprising:

a pool cover having a surface area and an aperture located within a portion of said surface area, said portion of said surface area of the pool cover being at a lower elevation than a remaining surface area of said pool cover to remove accumulations from the pool cover by gravity through said aperture, said lower elevation being at a water level of the pool, and conduit means for disposing said accumulations fully through said aperture, said conduit adapted to be containment being connected to an outlet in a wall of the pool, and said conduit means having at least a portion thereon disposed below the water in the pool and a portion connected to a drain fitting having a drain opening, said drain opening being substantially level with said portion of said surface area of said pool cover at water level, such that a substantial amount of accumulations do not collect on top of said cover before the accumulations are drained through said drain opening.

2. A self-draining pool cover according to claim 1 wherein a drain fitting is attached to the aperture in the pool cover.

3. A self-draining pool cover according to claim 1 wherein said drain fitting includes a passageway and said pool cover includes a flexible first hose connecting said drain fitting with the outlet in the wall of the pool.

4. A self-draining pool cover according to claim 3, wherein disposal means is a sewer.

5. A self-draining pool cover according to claim 3 wherein said portion of said first hose is disposed in water in said pool to facilitate draining said accumulation.

6. A self-draining pool according to claim 3 wherein said first hose is made of plastic material.

7. A self draining pool cover according to claim 3 wherein the conduit means for disposing includes a second hose, for discharging the accumulations to disposal means located on an outer side of the pool wall and connected to said first hose through said outlet.

8. A self-draining pool cover according to claim 1 wherein said pool cover having a center and wherein said aperture is located by the center of the pool cover.

9. A self-draining pool cover according to claim 1 wherein said pool cover has a circular shape.

10. A self-draining pool cover according to claim 1 wherein said pool cover has a rectangular shape.

11. A self-draining pool cover according to claim 1 wherein said pool cover has an oval shape.

12. A self-draining pool cover according to claim 1 wherein said pool cover has a square shape.

13. A self-draining pool cover according to claim 3 wherein said drain fitting is a drain assembly and further including a hose adaptor wherein said drain assembly is secured to said pool cover and said hose adaptor is coupled to a drain flange at one end and is secured to said first hose at said other end.

14. A self-draining pool according to claim 12 further comprising a clamp for securing said hose adaptor to said hose at said other end of said hose adaptor.

* * * * *